US006122792A

United States Patent [19]

Roy

[11] Patent Number: 6,122,792

[45] **Date of Patent: *Sep. 26, 2000**

[54] TUBE AND HOSE CLEANING BRUSH

[76] Inventor: Richard Roy, 12950 SE. 104th Ct., Belleview, Fla. 34420

[ * ] Notice: This patent is subject to a terminal disclaimer.

[21] Appl. No.: 09/360,780

[22] Filed: Jul. 26, 1999

Related U.S. Application Data

[63] Continuation-in-part of application No. 08/693,711, Aug. 7, 1996, Pat. No. 5,926,895.

[51] Int. Cl.[7] ..... A46B 5/02; B08B 9/02

[52] U.S. Cl. ..... 15/104.2; 15/143.1; 15/144.4; 15/164; 15/206

[58] Field of Search ..... 15/23, 104.05, 15/104.16, 104.2, 143.1, 160, 144.1, 144.4, 164, 206, 340.1, 104.165

[56] References Cited

U.S. PATENT DOCUMENTS

| | | | |
|---|---|---|---|
| 1,375,088 | 4/1921 | Fries | 15/104.05 |
| 2,172,195 | 9/1939 | Elson | 15/104.2 |
| 2,929,087 | 3/1960 | Salmon | 15/144.1 |
| 2,951,632 | 9/1960 | Hanson | 15/340.1 |
| 4,253,211 | 3/1981 | Mockel | 15/104.32 |
| 4,792,363 | 12/1988 | Franklin, Jr. | 15/104.2 |
| 4,819,291 | 4/1989 | Gunjian | 15/104.2 |
| 5,033,155 | 7/1991 | Klotz | 15/164 |
| 5,168,593 | 12/1992 | Poje | 15/104.2 |
| 5,253,386 | 10/1993 | LaLonde | 15/104.2 |
| 5,297,510 | 3/1994 | Cox | 15/104.2 |
| 5,560,069 | 10/1996 | Berger | 15/143.1 |

FOREIGN PATENT DOCUMENTS

| | | | |
|---|---|---|---|
| 449467 | 9/1927 | Germany | 15/104.2 |
| 592481 | 2/1934 | Germany | 15/104.2 |
| 6521 | 3/1906 | United Kingdom | 15/104.2 |
| 12360 | 5/1913 | United Kingdom | 15/104.2 |
| 872987 | 7/1961 | United Kingdom | 15/143.1 |

*Primary Examiner*—Randall E. Chin
*Attorney, Agent, or Firm*—Saliwanchik, Lloyd & Saliwanchik

[57] ABSTRACT

The subject invention pertains to a tool that may be used for cleaning the interior of tubing or hoses. The tool comprises a brush or similar cleaning device attached to an end of a length a semi-rigid tube. In use, the cleaning tool is inserted into a a tube or hose opening and the interior surface of the hose is then cleaned of dust and other entrapped particles.

6 Claims, 6 Drawing Sheets

TUBE AND HOSE CLEANING BRUSH

CROSS-REFERENCE TO A RELATED APPLICATION

This application is a continuation-in-part of co-pending patent application Ser. No. 08/693,711, filed Aug. 7, 1996, now U.S. Pat. No. 5,926,895.

BACKGROUND OF THE INVENTION

There are many situations where it is necessary to clean the interior of hoses and/or tubing. Such cleaning chores often present great challenges due to the inaccessability of the interior spaces of tubes and hoses. These spaces are not only difficult to access but the tubes or hoses may present particular challenges such as recalcitrant debris and/or the delicate nature of the hose or tube. Also, bends or turns in tubes or hoses also make cleaning difficult. One example of hoses that are hard to clean is vacuum cleaner hoses.

Vacuum cleaners are widely used in industrial, commercial, residential, and other indoor environments to remove dust, dirt, debris, and other particles from floors and floor coverings, window treatments, furniture, sculptures and other decorative items, plants, and other articles. In some instances, vacuum cleaners are also used in outdoor applications.

Most vacuum cleaners are machines that operate by creating an air suction force that is strong enough to lift dust, dirt, and other small particles from the articles to be cleaned. The particles are usually directed into the vacuum cleaner through a cleaning head that increases the cleaning contact area. Additionally, some machines have brushes that help sweep the particles into the vacuum cleaner. After being drawn through the cleaning head, the particles are directed into a collection bag or similar receptacle. The collection bag is periodically emptied or replaced.

There are many different versions of vacuum cleaners. Common vacuum cleaner designs include hand-held, upright, and canister models. Hand-held and upright models often incorporate all the elements of the cleaner into a single unit. In contrast, canister models usually house a motor and collection bag in a rolling unit attached by a flexible hose to a cleaning head. Many upright models, in addition to having a floor-level cleaning head, also have a flexible hose that can be fitted with supplementary cleaning tools, thereby expanding the cleaning capabilities of the vacuum cleaner. Also, hand-held models frequently have a short tube through which dirt and dust are directed into a collection bag.

The tube or flexible hose attached to many vacuum cleaners comes in a variety of lengths and configurations. For example, it may be rigid and fairly short, as in a hand-held vacuum. Or it may be flexible and relatively long, allowing the user to position the head into corners, behind furniture, along ceilings, and other difficult-to-reach locations.

For optimal cleaning performance and vacuum cleaner longevity, the air suction supplied by the vacuum cleaner motor must not be blocked at any point along the path from the motor to the cleaning head of the vacuum cleaner, which contacts the surface to be cleaned. While vacuum cleaner users generally realize the importance of emptying or replacing the vacuum cleaners' dust collection bags regularly to maintain peak performance, many do not realize that another region of potential air flow blockage is often overlooked: the vacuum cleaner hose. Removing accumulated particulate matter from the inside surface of the hose allows the vacuum cleaner to sustain its suction force without placing additional stress on the motor. Thus, hose cleaning serves to maintain a vacuum cleaner's efficiency and prolong its life by reducing demands on its motor.

In addition to the failure of most people to recognize the importance of a clean vacuum cleaner hose, the vacuum cleaner hose is very difficult to effectively clean even if one desired to do so. The subject invention provides a simple tool for effective vacuum cleaner hose cleaning.

BRIEF SUMMARY OF THE INVENTION

The subject invention pertains to tools and methods useful for easily and efficiently cleaning the interior of tubing and hoses. In a preferred embodiment, the tools of the subject invention comprise a brush or other cleaning head attached to a length of semi-rigid elongate body. The elongate body to which the cleaning device is attached is sufficiently rigid to facilitate clearing away of particles from the inside walls of the tube or hose. The elongate body is also sufficiently flexible to pass through a tube or hose having one or more bends or curves. Additional, the elongate body is available in a variety of lengths to accommodate a variety of tube or hose lengths. Advantageously, the bristles or other cleaning surface of the cleaning head are sufficiently rigid to facilitate removal of particulate matter and other debris impacted upon the inner surface of the tube or hose.

The tool of the subject invention can be inserted into an open end of the tube or hose. The interior surface of the tube or hose can then be brushed free of any particulate matter by simple manipulation of the cleaning device. When the cleaning is completed, the cleaning tool of the subject invention can be easily cleaned if necessary and stored in a convenient location.

DETAILED DISCLOSURE OF THE INVENTION

Figure 1:
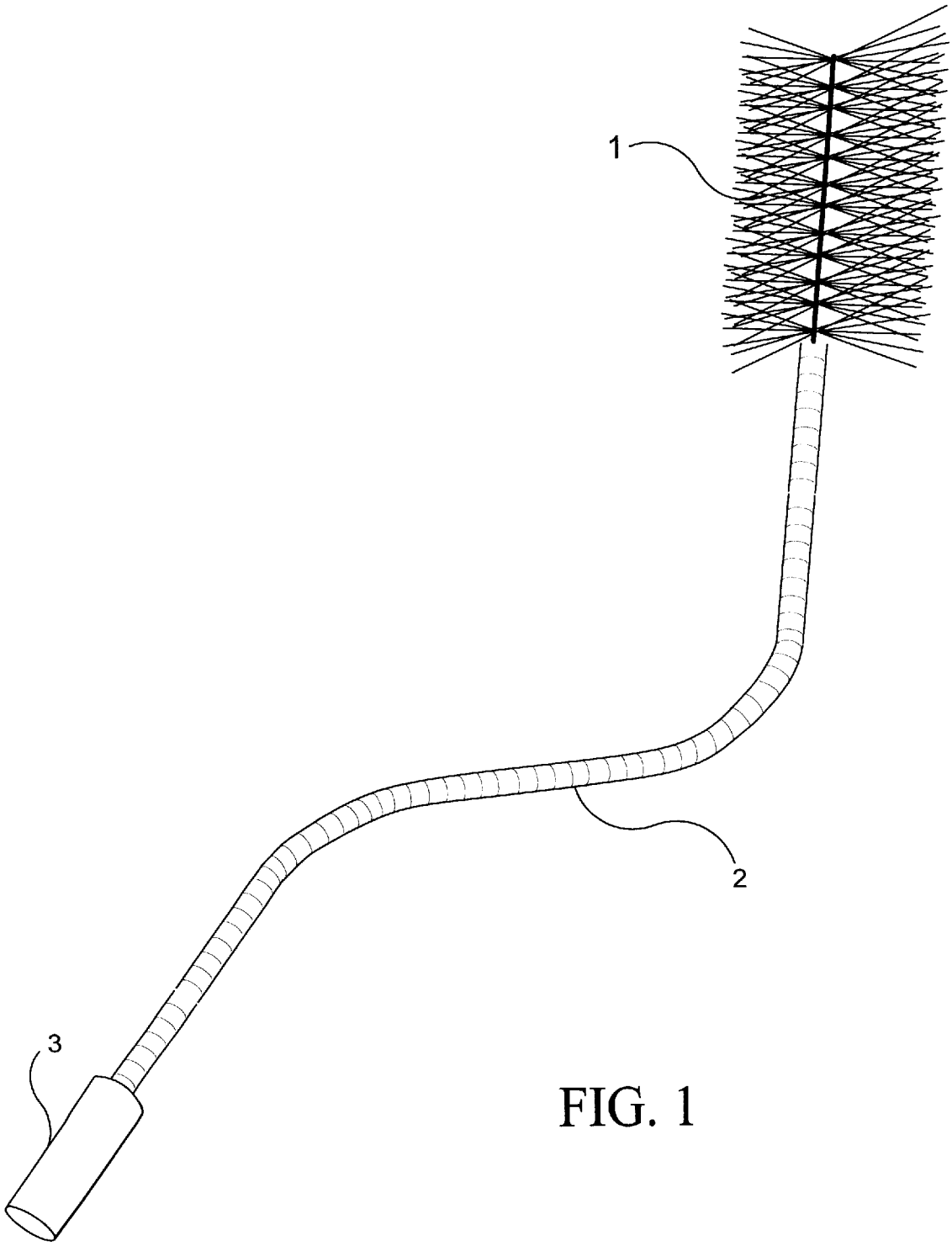
FIG. 1 is an illustration of a specific embodiment of the subject invention.
Figure 2A:
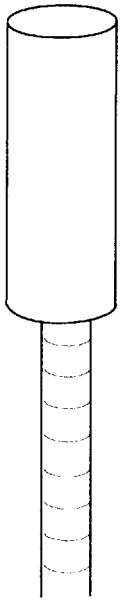
FIG. 2A–2F shows alternative types of handles.
Figure 2B:
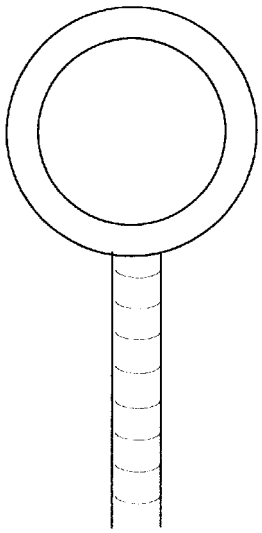
Figure 2C:
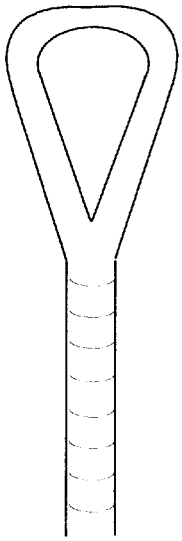
Figure 2D:
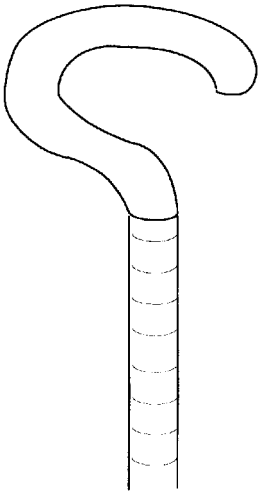
Figure 2E:
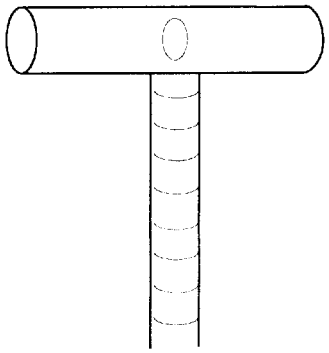
Figure 2F:
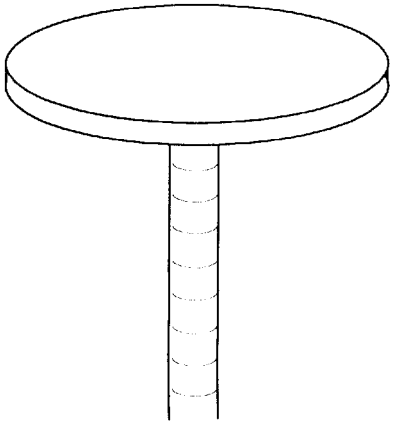

The subject invention pertains to tools for cleaning the interior surface tubing or hoses of particulate matter or debris. FIG. 1 illustrates one specific embodiment of the subject invention.

In a preferred embodiment, the tool of the subject invention comprises a cleaning head 1 that is attached to a sturdy, yet flexible semi-rigid elongate longitudinal body (rod or stem) 2. The cleaning head 1 typically will comprise stiff bristles having sufficient rigidity to remove caked-on dust, dirt, and grime from the interior of a tube or hose. The brush may have, for example, stiff plastic bristles. Other appropriate materials, including, for example, rubber and metal, may be used to make the cleaning head. The bristles may come in a variety of lengths and thicknesses, depending on the amount and type of cleaning required. The cleaning head 1 may be a cylindrical brush, the brush being available in a variety of diameters and lengths matching the various diameters of vacuum cleaner hoses or other hoses or tubes to be cleaned. Examples include, but are not limited to, a cylindrical brush of about 1 inch in diameter and about 6 inches long for cleaning standard size tubes or hoses, or a large diameter brush for cleaning large diameter tubes or hoses. Those skilled in the art, having the benefit of the instant disclosure, will appreciate that the brush can be made a variety of sizes to accommodate uses in different applications. Thus, the brush may be, for example, from about ¾-inch in diameter to about 6 inches in diameter. Preferably, the brush is from about 1 inch to 3 inches in diameter.

The brush, handle, and elongate handle are exemplified herein as being cylindrical (i.e. circular in cross-section); however, those skilled in the art will appreciate that other shapes can be used and their diameter/size can be analogous to the sizes described herein for the circular cross-section. Thus, the cleaning head may be spherical or any other shape or size that will fit into a tube or hose. The brush 19 may also be tapered to allow for easy removal and insertion into a hose. In another embodiment, the cleaning head 1 may be made to rotate about the longitudinal axis of the hose, powered by a battery or other energy source.

Figure 8:
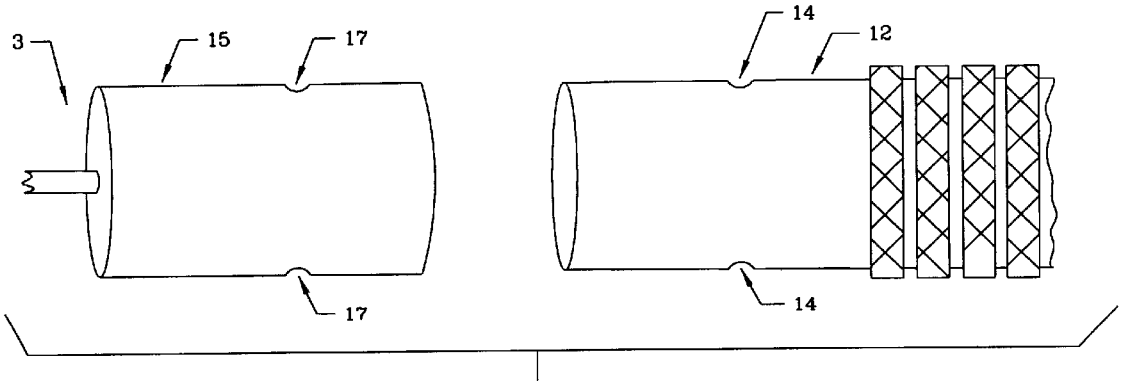
FIG. 8 shows a bolt or pin method for detachably attaching a handle to the elongate body.
Figure 9:
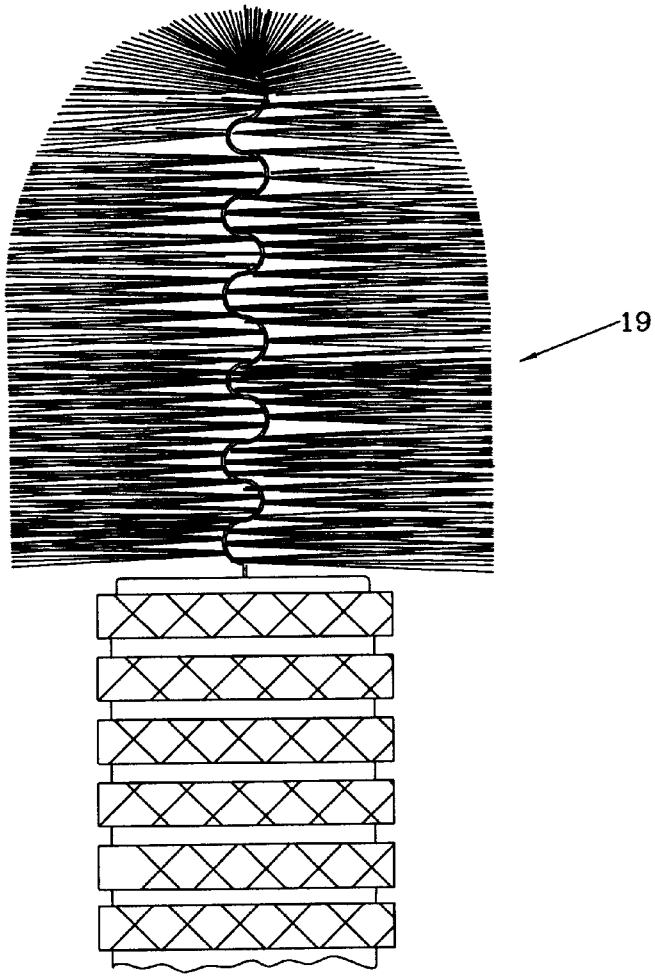
FIG. 9 shows a tapered brush head.
Figure 10:
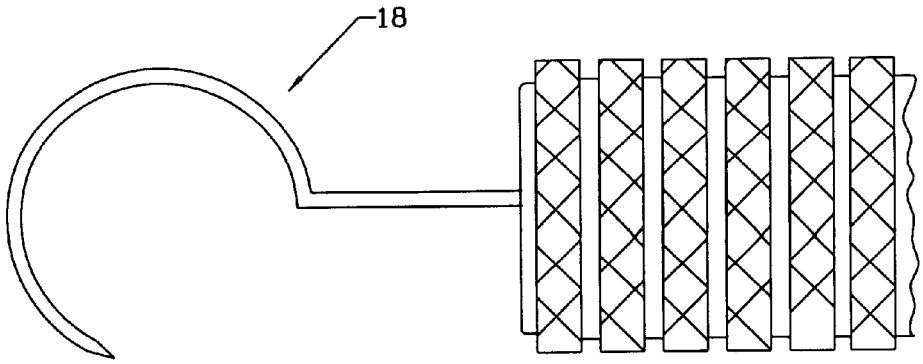
FIG. 10 shows a hook attachment.

In addition to brushes, the cleaning head 1 may incorporate a hook 18 as shown in FIG. 8. The hooked cleaning head 18 enables the tool to remove articles of clothing, such as bathing suites, from the tube or hose by hooking onto the article and pulling it out of the tube or hose. The hook cleaning head 18 is especially useful in clearing long tubes or hoses, such as those used in cental vacuum cleaner units or tubing in hot tubs and spas.

In one embodiment, the cleaning head 1 comprises stiff bristles having sufficient rigidity to remove caked-on dust, dirt, and grime from the interior of a tube or hose attached to a semi-rigid stem. The semi-rigid stem permits the brush to flex through corners and angles within the tube or hose. The semi-rigid stem may come in a variety of lengths and thicknesses, depending on the amount of cleaning required.

Figure 3:
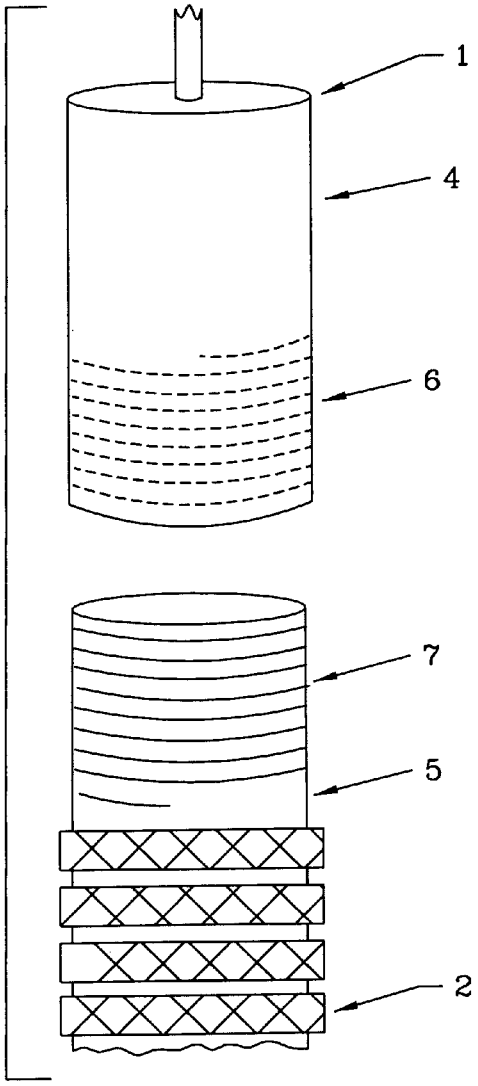
FIG. 3 shows a screw-on method for detachably attaching a cleaning head to the elongate body.

In another embodiment as shown in FIG. 3, the cleaning head 1 is detachably attached to the elongate body 2. The inner diameter of the cleaning head base 4 is slightly greater then the exterior diameter of the cleaning head end 5 of the elongate body 2. The interior surface of the cleaning head base 4 can be cut with female threads 6 and exterior surface of the cleaning head end 5 can be cut with male threads 7. In this embodiment, the cleaning head 1 is securely attached to the elongated body 2 by utilizing the male 7 and female 6 threads to screw the cleaning head base 4 onto the cleaning head end 5. This allows for the use of various types of cleaning heads depending on the type of brush required.

Figure 4A:
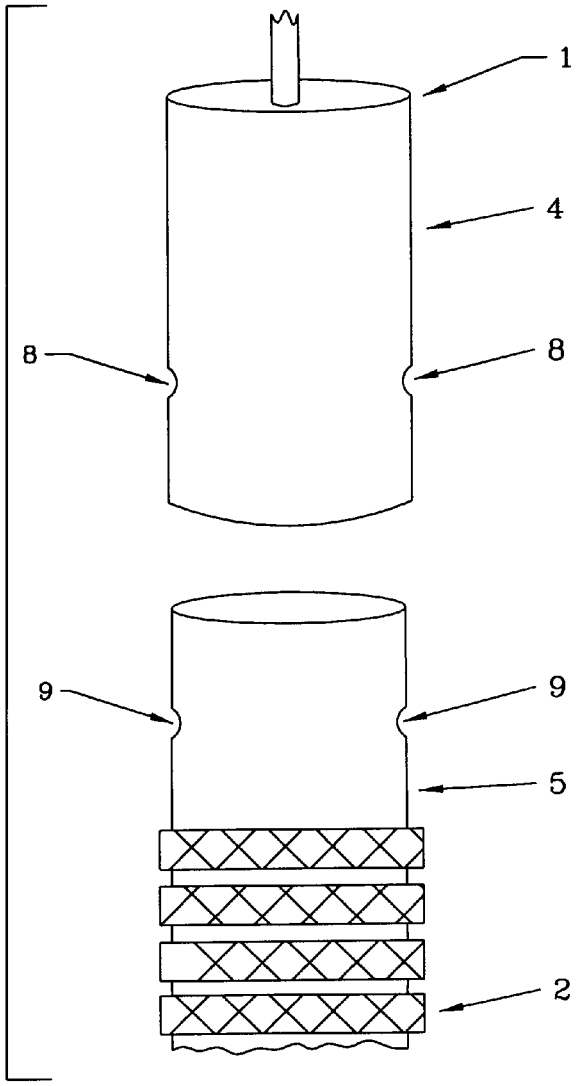
FIG. 4A–4B shows a bolt or pin method for detachably attaching a cleaning head to the elongate body.
Figure 4B:
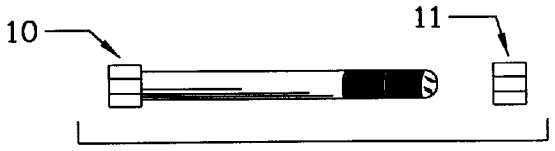

In an alternative embodiment, as shown in FIG. 4, the cleaning head 1 can be attached to the elongate body 2 using a nut and bolt assembly. As in the threaded embodiment, the inner diameter of the cleaning head base 4 is slightly greater then the exterior diameter of the cleaning head end 5 of the elongate body 2. Two opposing holes 8 are cut into the cleaning head base 4 and two matching opposing holes 9 are cut into the cleaning head end 5. The cleaning head end 5 is inserted into the cleaning head base 4 and the matching opposing holes (8 and 9) are aligned. A bolt 10 is passed through the matching opposing holes (8 and 9) and a matching lock nut 11 is fastened onto the end of the bolt 10, securely attaching the cleaning head base 4 to the cleaning head end 5.

In further embodiments the nut and bolt assembly can be replaced by a self-locking pin. Examples of these include, but are not limited to, push pins and cotter pins.

The elongate body 2 can be, for example, a semi-rigid length of hollow or solid tube which may have a circular or other-shaped cross section. The elongate body 2 may be made to any length to accommodate tubing and hoses of different lengths. Examples include, but are not limited to, 3 to 15 feet in length to accommodate portable vacuum cleaner hoses or portable hot tubs. More preferably the elongate body 2 will be between about 5 and 10 feet and most preferably between about 6 and 8 feet. A person skilled in the art, having the benefit of the instant disclosure, will appreciate that the elongate body 2 can be made longer to accommodate a particular purpose. Thus, the elongate body 2 can be as long as about 25 to 30 feet for cleaning, for example, a central vacuum unit's interior hose lines in in-ground pools, spas or hot tubs. The elongate body 2 may be expandable and contractible so that, when not in use, the tool can be stored in a small space. If the elongate body 2 telescopes, it is necessary to have a locking mechanism to hold the tube in place when it is in use in its expanded form.

Figure 5:
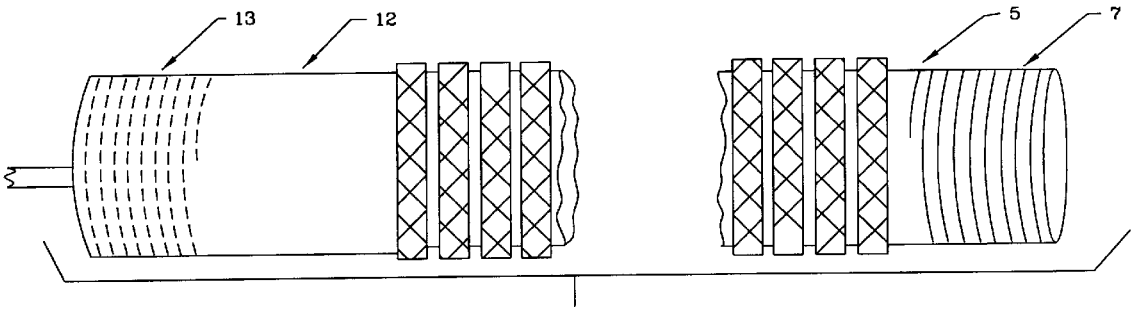
FIG. 5 shows an elongate body adapted for the screw-on method for detachably attaching individual sections of elongate bodies together.

Additionally as shown in FIG. 5, the length of the elongate body 2 may be increased by attaching sections of elongate bodies 2 together. The inner diameter of the handle end 12 of the elongate body 2 is slightly greater then the exterior diameter of the cleaning head end 5. The interior surface of the handle end 12 can be cut with female threads 13 and the exterior surface of the cleaning head end 5 can be cut with male threads 7. The elongate bodies 2 are securely attached together by utilizing the male 7 and female 13 threads to screw a handle end 12 onto a cleaning head end 5. This allows for increasing the overall length of the elongate body 2 as required.

Figure 6:
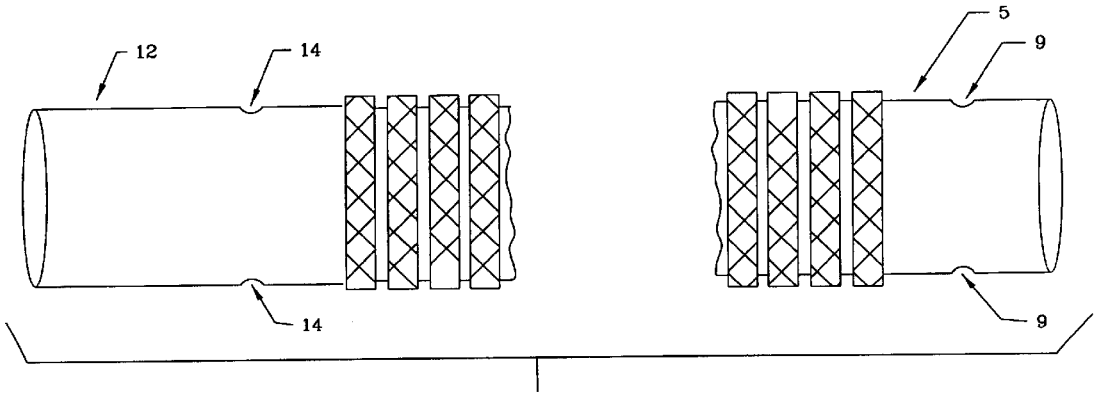
FIG. 6 shows an elongate body adapted for a bolt or pin method for detachably attaching individual sections of elongate bodies together.

In an alternative embodiment, as shown in FIG. 6, multiple elongate bodies 2 can be attached together using a nut and bolt assembly. As in the above embodiment, the inner diameter of the handle end 12 is slightly greater then the exterior diameter of the cleaning head end 5 of the elongate body 2. Two opposing holes 14 are cut into the handle end 12 and two matching opposing holes 9 are cut into the cleaning head end 5. A cleaning head end 5 is inserted into a handle end 12 and the matching opposing holes (14 and 9) are aligned. A bolt 10 is passed through the matching opposing holes (14 and 9) and a matching lock nut 11 is fastened onto the end of the bolt 10, securely attaching a handle end 12 to a cleaning head end 15.

In further embodiments the nut and bolt assembly can be replaced by a self-locking pin. Examples of these include, but are not limited to, push pins and cotter pins.

The elongate body 2 portion of the tool of the subject invention may be about 1 inch in cross-sectional diameter, but may be larger or smaller, depending on the application. More rigid materials and larger cross-sectional areas allow the user to more easily apply pushing forces in order to direct the cleaning tool into a tube or hose; more flexible materials and smaller cross-sectional areas allow the user to bend the tool into a compact configuration for storage ease.

As used herein, reference to a "semi-rigid" elongate body refers to an elongate body with sufficient rigidity to push a cleaning head through a tube or hose without excessive bending of the elongate body. Excessive bending is defined herein as bending which prevents or impedes the elongate body from further movement through the tube or hose. The semi-rigid elongate body must also resist rotational torque so that the brush (or other cleaning head device) can be effectively rotated by rotating the opposite end of the elongate body. If the elongate body is capable of rotational twisting, it will become difficult to rotate the cleaning head by simply rotating the opposite end of the elongate body. Thus, an important aspect of the subject invention is the provision of a brush (or other cleaning device) attached to a semi-rigid elongate body wherein the brush is sufficiently stiff to effectively clean impacted dirt from the interior of a tube or hose, and the elongate body is sufficiently rigid to facilitate pushing the brush through a tube or hose and twisting the brush within the tube or hose, even when substantial dirt and debris are present.

Suitable materials from which the elongate body 2 can be constructed include, but are not limited to, plastic, wood, rubber, and metals. A particularly preferred embodiment utilizes an about ½-inch diameter hollow conduit tube as the elongate body 2. Another preferred embodiment is semi-rigid rubber hose such as automotive hoses. Semi-rigid woven cables can also be used. Preferably, the semi-rigid elongate body 2 is non-conductive. The body may be manufactured in any combination of materials, lengths, and cross-sectional areas to impart the desired performance and physical characteristics, including weight, size, color, strength, and durability. Preferably, the elongate body 2 will be greater than ⅛" in diameter and less than 3 inches in diameter. Most preferably the diameter of the elongate body 2 will be between ¼-inch and 1 inch in diameter.

The tool of the subject invention may optionally comprise a handle portion 3. The handle may be, for example, a simple cylinder. Alternatively, as shown in FIGS. 2A–2F, the handle can be of any shape, preferably one that facilitates its storage on hooks or brackets, which are often found in tool storage areas. The handle may be made of any of a number of materials, including wood, plastic, rubber, and metal. A solid handle may also be covered with a spongy rubber or other material for comfort. The handle 3 may be attached to the elongate body 2 by adhesives, nails, staples, or other such fastening means or a combination thereof.

Figure 7:
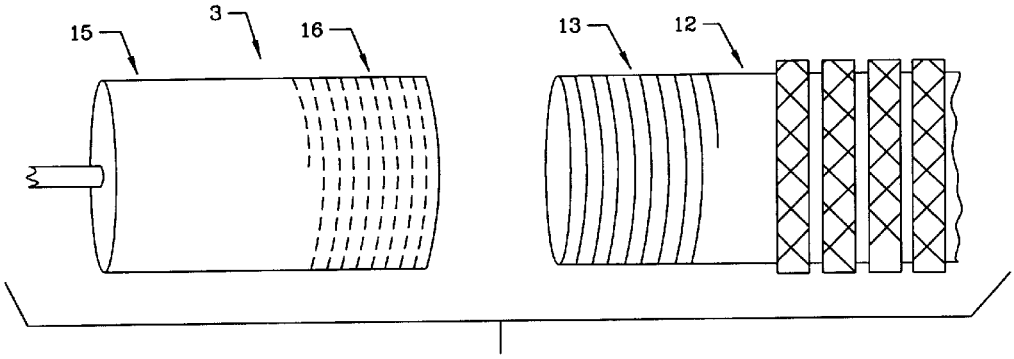
FIG. 7 shows a screw-on method for detachably attaching a handle to the elongate body.

Additionally, as shown in FIG. 7, the handle 3 may be detachably attached to the elongate body 2. The inner diameter of the handle end 12 of the elongate body 2 is slightly greater then the exterior diameter of the handle base 15 of the handle 3. The interior surface of the handle end 12 is cut with female threads 13 and the exterior surface of the handle base 15 is cut with male threads 16. The elongate body 2 and handle 3 are securely attached together by utilizing the male 16 and female 13 threads to screw a handle base 15 into the handle end 12. This allows for removing the handle 3 to increasing the overall length of the elongate body 2 or to replace it with a different handle 3.

In an alternative embodiment, as shown in FIG. 8, the handle 3 may be removably attached to the elongate body 2 using a nut and bolt assembly. As in the above embodiment, the inner diameter of the handle end 12 is slightly greater then the exterior diameter of the handle base 15. Two opposing holes 17 are cut into the handle base 15 and two matching opposing holes 14 are cut into the handle end 12. The handle base 15 is inserted into the handle end 12 and the matching opposing holes (17 and 14) are aligned. A bolt 10 is passed through the matching opposing holes (17 and 14) and a matching locknut 11 is fastened onto the end of the bolt 10, securely attaching the handle base 15 to the handle end 12.

In further embodiments the nut and bolt assembly can be replaced by a self-locking pin. Examples of these include, but are not limited to, push pins and cotter pins.

It should be understood that the embodiments described herein are for illustrative purposes only and that various modifications or changes in light thereof will be suggested to persons skilled in the art and are to be included within the spirit and purview of this application and the scope of the appended claims.

What is claimed is:

1. A tool for cleaning the interior of tubing and hoses, wherein said tool comprises a cleaning head and an elongate body, wherein said cleaning head comprises a brush, wherein said brush is at least about 1 inch in diameter, and wherein said elongate body comprises a cleaning head end and a handle end, opposite to said cleaning head end, and said elongate body has a diameter of at least about ½ inch and is at least about 4 feet in length and has sufficient rigidity to facilitate pushing and twisting of said brush within said tube or hose to remove dirt and debris without damaging said tube or hose, and wherein said brush has sufficient rigidity to remove dirt and debris without damaging the said tube or hose.

2. The tool, according to claim 1, wherein said cleaning head is detachably attached to said cleaning head end of said elongate body.

3. The tool, according to claim 1, which further comprises a handle.

4. The tool, according to claim 3, wherein said handle is detachably attached to said handle end of said elongated body.

5. The tool, according to claim 1, wherein said elongate body comprises a hollow conduit tube.

6. The tool, according to claim 1, where a plurality of said elongate bodies are serially detachably attached.

* * * * *